US005878500A

United States Patent [19]

Emerson

[11] Patent Number: 5,878,500

[45] Date of Patent: Mar. 9, 1999

[54] SELF-OPENING FOLDING KNIFE

[76] Inventor: Ernest R. Emerson, 4142 W. 173rd St., Torrance, Calif. 90504

[21] Appl. No.: 970,413

[22] Filed: Nov. 14, 1997

[51] Int. Cl.[6] ..... B26B 29/02

[52] U.S. Cl. ..... 30/158; 30/143; 224/232

[58] Field of Search ..... 30/151, 155, 156, 30/157, 160, 161, 158, 142, 143; D8/99; 224/232

[56] References Cited

U.S. PATENT DOCUMENTS

| | | | |
|---|---|---|---|
| D. 228,545 | 10/1973 | Beddick et al. | D8/99 |
| 233,091 | 10/1880 | Grilley | 30/155 |
| D. 321,820 | 11/1991 | Russell | D8/99 |
| D. 365,266 | 12/1995 | Hasegawa | D8/99 |
| D. 367,599 | 3/1996 | Sakai | D8/99 |
| 825,093 | 7/1906 | Watson | 30/161 |
| 4,274,200 | 6/1981 | Coder | 30/161 |
| 4,426,779 | 1/1984 | Morgan | 30/158 |
| 4,494,310 | 1/1985 | Slaughter | 30/157 |
| 4,848,000 | 7/1989 | O'Dell | 30/158 |
| 4,909,424 | 3/1990 | Reynolds | 224/232 |
| 4,947,552 | 8/1990 | Barnes | 30/160 |
| 5,095,624 | 3/1992 | Ennis | 30/161 |
| 5,349,753 | 9/1994 | Gaffney | 30/160 |
| 5,537,750 | 7/1996 | Seber et al. | 30/160 |
| 5,699,615 | 12/1997 | Chen | 30/161 |

*Primary Examiner*—Hwei-Siu Payer
*Attorney, Agent, or Firm*—Frank D. Gilliam

[57] ABSTRACT

A folding knife that is self opening when removed from a container such as a holster or pocket. The knife includes a handle and a knife blade with the blade hinged to the handle for folding from an extended, use, position to a stored position in a slot in the handle. A pin is formed on the knife blade adjacent to the hinged end, extending away from the blade when the blade is folded. When the knife is pulled from a container, the pin will snag the container just before the knife is fully removed, causing the blade to unfold to the use position. Preferably, the pin is hook-shaped with an end extending along the blade towards the blade tip. A releasable locking arrangement to lock the blade against folding while in use and for releasing the blade when desired for folding is preferably included.

5 Claims, 1 Drawing Sheet

SELF-OPENING FOLDING KNIFE

FIELD OF THE INVENTION

This invention relates to a pocket knife having a blade that folds and that includes a mechanism for automatically opening the blade when the knife is withdrawn from a pocket.

BACKGROUND OF THE INVENTION

A very great many types of folding pocket knives have been developed in which a blade is hinged so as to fold into a handle to cover the sharp blade edge when the knife is being carried and so as to be unfolded into an extended position for use. The edge of the blade opposite the sharp edge is generally slightly exposed and includes a notch or recess for engagement by a fingernail to pull the blade from the stored to the open position.

Such knives may have one or more blades and may have other folding tools such as files, saw blades, scissors, etc. A locking device is often provided to hold the knife in the fully open, use, position and prevent the blade from accidentally folding the sharp blade edge against the user's fingers during use. A button, lever, or similar device is provided to unlock the blade and allow it to be folded.

Opening such a conventional pocket knife is slow and requires two hands, one holding the knife and the other engaging the blade during opening. This can be a significant problem where one hand holds an object to be cut, such as a rope under tension, while the other removes the folded knife from a holster, pocket or the like.

A number of different knives have been developed to open a folding pocket knife more rapidly. The best known is the so-called "switchblade" knife, having a blade spring loaded toward the extended position and a push button latch holding the knife in the folded position. Pressing the button releases the blade, which springs to the open position. While effective, carrying such knives is unlawful in all, or most, states.

Knives exist in which the blade is slidably held in the handle and is extended by sliding a button secured to the blade along the side of the handle to extend the blade. These knives generally have relatively short blades and are prone to jamming of the slide mechanism. Handles on such knives are not well configured to the hand, generally being straight rectangles when a reasonably long blade is to be extended. Further, the mechanisms for locking the blade in housed and extended positions are often not reliable and may release in use.

Thus, there is a continuing need for an improved folding knife that will automatically open during removal of the knife from a holster or pocket, that requires only one hand to open and that does not require any manipulation of the knife during removal other than the simple withdrawal of the knife from a holster, pocket or similar container.

SUMMARY OF THE INVENTION

The above-noted problems, and others, are overcome by a self-opening knife having a handle with a slot along one side, a knife blade hinged to the handle at one end for movement between an extended position for use and a closed position with the blade folded so that the sharp edge is housed in the slot.

A projection is formed on the blade edge opposite the sharp edge, the projection preferably extending from the blade in the general plane of the blade near the hinge. The projection is configured so as to catch on a container, such as a pants pocket, holster or the like, as the knife is withdrawn from the container to pivot the blade about the hinge to the extended position for use. Thus, the knife can be opened with one hand without any special manipulation of the knife.

Preferably, the projection is formed integrally with the blade, having side surfaces coplanar with the blade and has a hook-like shape with the tip of the hook extending toward the blade tip. A releasable locking means is preferably provided to lock the blade in the open position until the locking means is unlocked to permit manually folding the blade into the handle.

Therefore, it is an object of this invention to provide a self-opening folding knife that is automatically opened during removal from a container. Another object is to provide a self-opening folding knife that can be removed from a container and opened with one hand. A further object is to provide a self-opening folding knife that releasably locks in the open position when fully opened.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
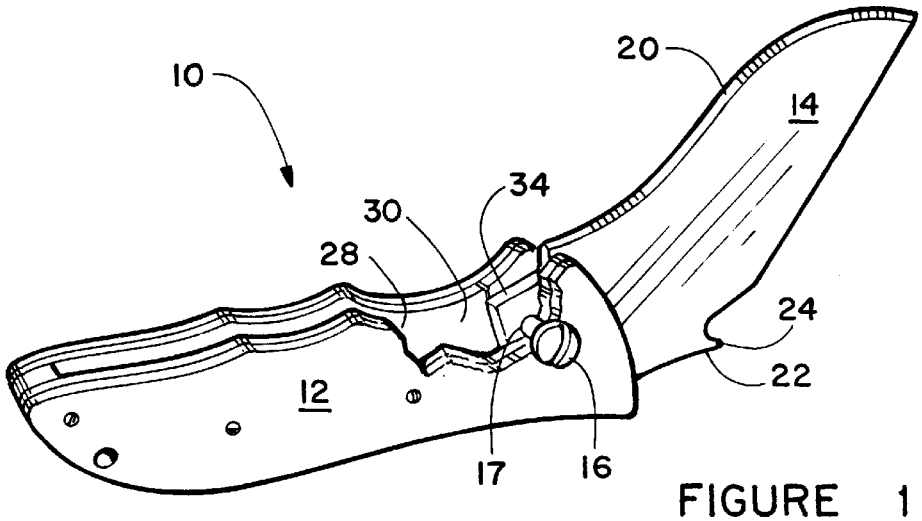
FIG. 1 is a perspective view of the self-opening knife in the partially open position.

Referring to the Figures, there is seen a folding knife 10 having a handle 12 with a blade 14 foldable about a hinge pin 16 which extends through a hole 17 in blade 14. In the closed position of FIG. 4, blade 14 is rotated counter clockwise from the position shown in FIGS. 1 and 2 and extends into a slot 18 along handle 12 to house sharp edge 20 of plate 14. At least a part of slot 18 may extend entirely through handle 12, providing an opening on the back of the handle 18 through which water or debris that may enter slot 18 during use can exit.

Figure 2:
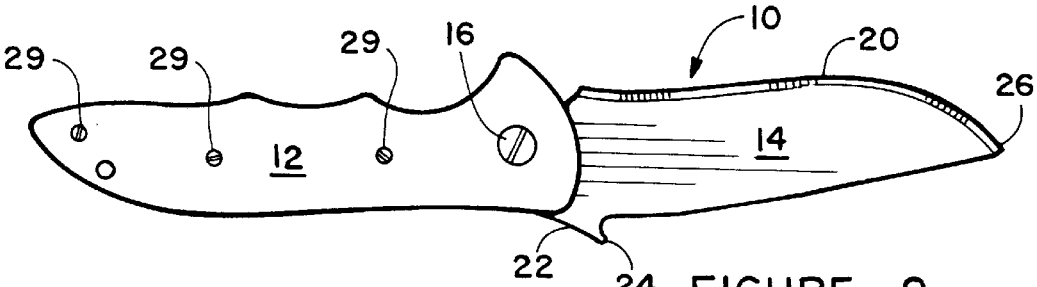
FIG. 2 is a side elevation view of the self-opening knife in the open position.
Figure 3:
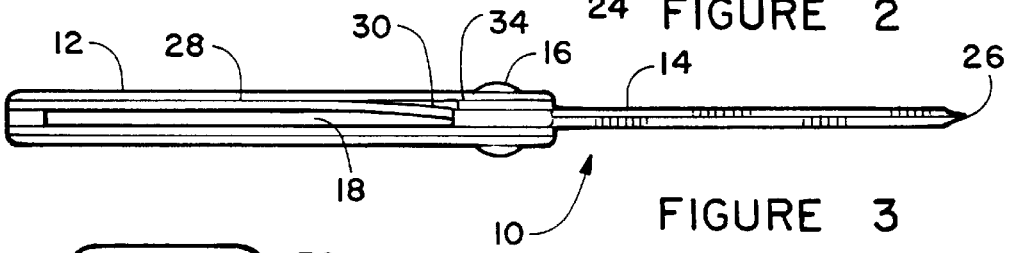
FIG. 3 is a plan view of the self-opening knife in the open position from the blade edge side.

A projection 22 extends from the back side of blade 14 near the end of the blade that engages hinge pin 16. Projection 22 is preferably hook shaped with an end 24 -extending towards tip 26 of blade 14. Blade 10 is stored in a container such as a pants pocket, holster 32 or the like with the hinge pin end furthermost into the container. Pin 22 is configured so that when the blade is withdrawn from the container, the projection will catch on a container edge when the knife has mostly exited the container, causing blade 14 to unfold about hinge pin 16 to the fully open position shown in FIGS. 2 and 3. Thus, the knife is removed and moved to the operative position by a single, withdrawal, motion of one hand, allowing the user, for example, to hold tensioned ropes or the like in one hand to be cut with the knife held in the other hand.

Preferably, blade 14 is releasably locked in the extended position upon full deployment and removal from the container. As seen in FIG. 1, a plate 28 along one side of slot 18 is fastened to handle by screws 29 12 at the handle end away from hinge 16. The end of plate 28 nearest hinge pin 16 is free and biased slightly toward the center of the slot. The free end 30 of plate 28 is configured to lie alongside blade 14 in slot 18 except when blade 14 is fully deployed, whereupon the free end can engage blade stop portion 34 of the blade to prevent rotation of the blade to the closed position. As seen in FIG. 1, when blade 14 is further rotated slightly so that blade stop portion 34 moves just past free end 30, the free end motes toward the center of slot 18, so that free end 30 and blade stop portion 34 are abutting and coplanar to prevent folding of the blade.

An edge of plate 28 lies along the entrance to slot 18, so that the user may push the plate to the side of the slot with his or her fingertips so that the end 30 of plate 18 no longer engages the blade stop portion 34 (as seen in FIG. 1 with blade 14 partially folded) and the blade can be folded into slot 18.

Figure 4:
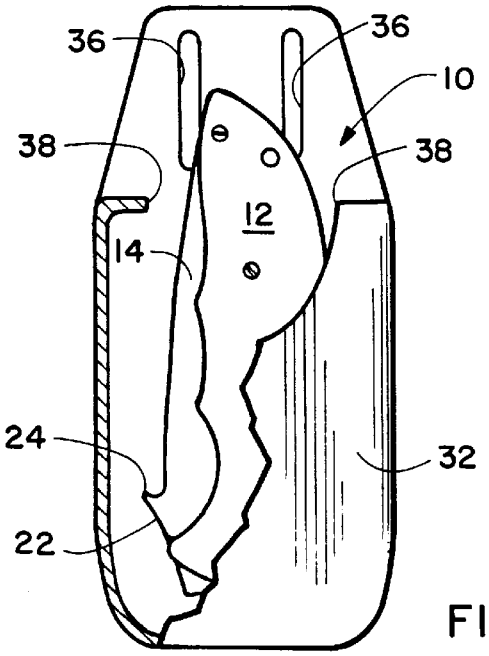
FIG. 4 is a front elevation view, party cut away, of the knife in a typical holster.

FIG. 4 is a schematic representation of a container 32, such as a holster, for carrying knife 10. Container 32, which could be formed from any suitable material, such as plastic leather or the like, includes slots 36 for mounting on a belt or the like. Inwardly extending abutments 38 are provided at the entrance end of container 32. Knife 14 is inserted hinged end first. A selected portion of the opposite end extends out of container 32. A user can grasp the extended end of knife 10 and pull it outwardly of container 32. When knife 14, is nearly out of container 32, pin 22 will engage an abutment 38, causing blade 14 to unfold to the fully deployed position. Where container 32 is a pocket in clothing, such as a conventional front pants pocket, projection 22 will snag the edge of the pocket, unfolding knife 14 as the knife leaves the pocket. Any other sort of container may be used, as desired, so long as a suitable abutment or adjacent fabric or the like is provided.

Figure 5:
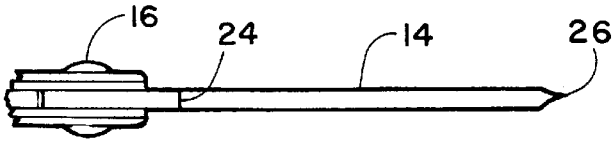
FIG. 5 is a detail view, partially cut away, showing a coplanar projection and knife blade.

FIG. 5 is a detail view showing projection 22 as coplanar with knife blade 14.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A self opening folding knife and holster assembly, which comprises:

an elongated handle;

an elongated knife blade having a sharp first edge and a second edge opposite said first edge, a tip end and a base end;

hinge means connecting said base end of said knife blade to said handle for movement between a first position with said sharp edge abutting said handle and a second position extending away from said handle;

releasable means for locking said blade in said second position a slot along a side of said handle for receiving and housing said one sharp first edge of said knife blade when said blade is in said first position; and a generally hook-shaped projection formed as part of said knife blade and substantially coplanar with said knife blade;

said projection extending away from said second edge adjacent to said base end;

said hook-shaped projection extending toward said tip end; and a holster for receiving said knife, said holster including at least one inwardly extending abutment configured to be engaged by said projection as said knife is withdrawn from said holster to rotate said knife blade from said first position to said second position.

2. A self opening folding knife and holster assembly, which comprises:

an elongated handle;

an elongated knife blade having a sharp first edge and a second edge opposite said first edge, a tip end and a base end;

hinge means connecting said base end of said knife blade to said handle for movement between a first position with said sharp edge abutting said handle and a second position extending away from said handle;

a slot along a side of said handle for receiving and housing said sharp first edge of said knife blade when said blade is in said first position; and a projection on said knife blade extending away from said second edge adjacent to said base end; and a holster for receiving said knife, said holster including at least one inwardly extending abutment configured to be engaged by said projection as said knife is withdrawn from said holster to rotate said knife blade from said first position to said second position.

3. The assembly according to claim 2 wherein said projection is generally hook-shaped with an end extending toward said tip end.

4. The assembly according to claim 2 wherein said projection is formed as part of said second edge and has side surfaces coplanar with said side surfaces of said blade.

5. The assembly according to claim 2 further including releasable means for locking said blade in said second position.

* * * * *